US005238180A

United States Patent [19]

Shimizu

[11] Patent Number: 5,238,180

[45] Date of Patent: Aug. 24, 1993

[54] CARTON AND CARTON BLANK

[75] Inventor: Jamie A. Shimizu, Hackensack, N.J.

[73] Assignee: Oak Tree Packaging Corporation, Montvale, N.J.

[21] Appl. No.: 814,700

[22] Filed: Dec. 30, 1991

[51] Int. Cl.[5] ..... B65D 5/42

[52] U.S. Cl. ..... 229/162; 229/936

[58] Field of Search ..... 229/40, 162, DIG. 9; 206/45.31

[56] References Cited

U.S. PATENT DOCUMENTS

| | | | |
|---|---|---|---|
| 2,529,725 | 11/1950 | Curie | 229/DIG. 9 |
| 2,795,365 | 6/1957 | Curie | 229/DIG. 9 |
| 2,899,123 | 8/1959 | Curie, Jr. | 229/40 |
| 2,987,176 | 6/1961 | Ringler | 229/40 |
| 3,096,880 | 7/1963 | Farquhar | 229/40 |
| 3,685,640 | 8/1972 | Tolaas | 206/45.31 |
| 3,713,530 | 1/1973 | Hanko | 206/45.31 |
| 3,894,681 | 7/1975 | Arneson et al. | 229/40 |
| 4,049,189 | 9/1977 | Wood | 229/40 |
| 4,355,758 | 10/1982 | Lavery | 229/162 |
| 5,004,104 | 4/1991 | Saulas | 229/40 |

FOREIGN PATENT DOCUMENTS

| | | | |
|---|---|---|---|
| 1571493 | 7/1980 | United Kingdom | 206/45.31 |

*Primary Examiner*—Gary E. Elkins
*Attorney, Agent, or Firm*—William H. Holt

[57] ABSTRACT

Two embodiments of cartons, and carton blanks for forming the same, wherein certain panel portions are scalloped by having closure flaps for adjacent blanks scavenged therefrom to minimize the use of paperboard, thus providing an economical carton which includes windows for allowing partial viewing of the contents and yet providing the panels with corner portions for reinforcing and strengthening the cartons.

12 Claims, 4 Drawing Sheets

CARTON AND CARTON BLANK

This invention relates to a carton blank and a carton to be erected therefrom and, more particularly, to a blank and carton that are more economical than similar products because of an improved use of paperboard stock, or other material, from which the blanks and cartons are cut, stamped, or otherwise formed.

BACKGROUND OF THE INVENTION

Cartons have been formed from carton blanks made from paper, cardboard and/or plastic sheet material for many, many years and may be intentionally expensive or inexpensive depending upon the end use in any particular instance. Expensive items are usually packaged in relatively expensive cartons. Examples of expensive packages would be those used for jewelry, perfumes or the like. Inexpensive or mundane items are more likely to be packaged, shipped and sold in economical cartons.

BRIEF SUMMARY OF THE INVENTION

The present invention relates to economical packaging such as might be used for protecting articles during shipment in larger boxes, or used for displays on shelves, and the like.

It is an object of the invention to provide cartons, and blanks therefor, in an economical fashion by using a minimal amount of sheet material for forming the carton blank and the resultant carton to be erected therefrom.

Another object of the invention is to provide a carton including a plurality of panels forming front, rear and sides of the carton and having closure flaps for the top and bottom thereof wherein some of the panels are scalloped and provide windows in the carton for at least partially viewing the contents thereof.

A further object of the invention is to provide a series of carton blanks to be cut from a single piece of sheet material, such as paperboard and the like, wherein part of the material which forms closure flaps for one carton is scavenged from panel forming portions of an adjacent carton.

A still further object of the invention is to provide a carton, and a carton blank therefor, wherein a panel portion has at least one part removed therefrom for providing a window in the carton, and the window being located at one end of the panel portion and shaped to provide an opening which extends longitudinally and inwardly from the extreme corners of the panel portion.

Another object of the invention is to provide a carton blank for a carton having closure flaps for closing the ends thereof wherein the closure flaps include end portions scavenged from an adjacent panel portion of the blank and the panel portion thereby includes corner portions for reinforcing and providing strength to the carton to be constructed therefrom.

DETAILED DESCRIPTION OF THE INVENTION

Figure 1:
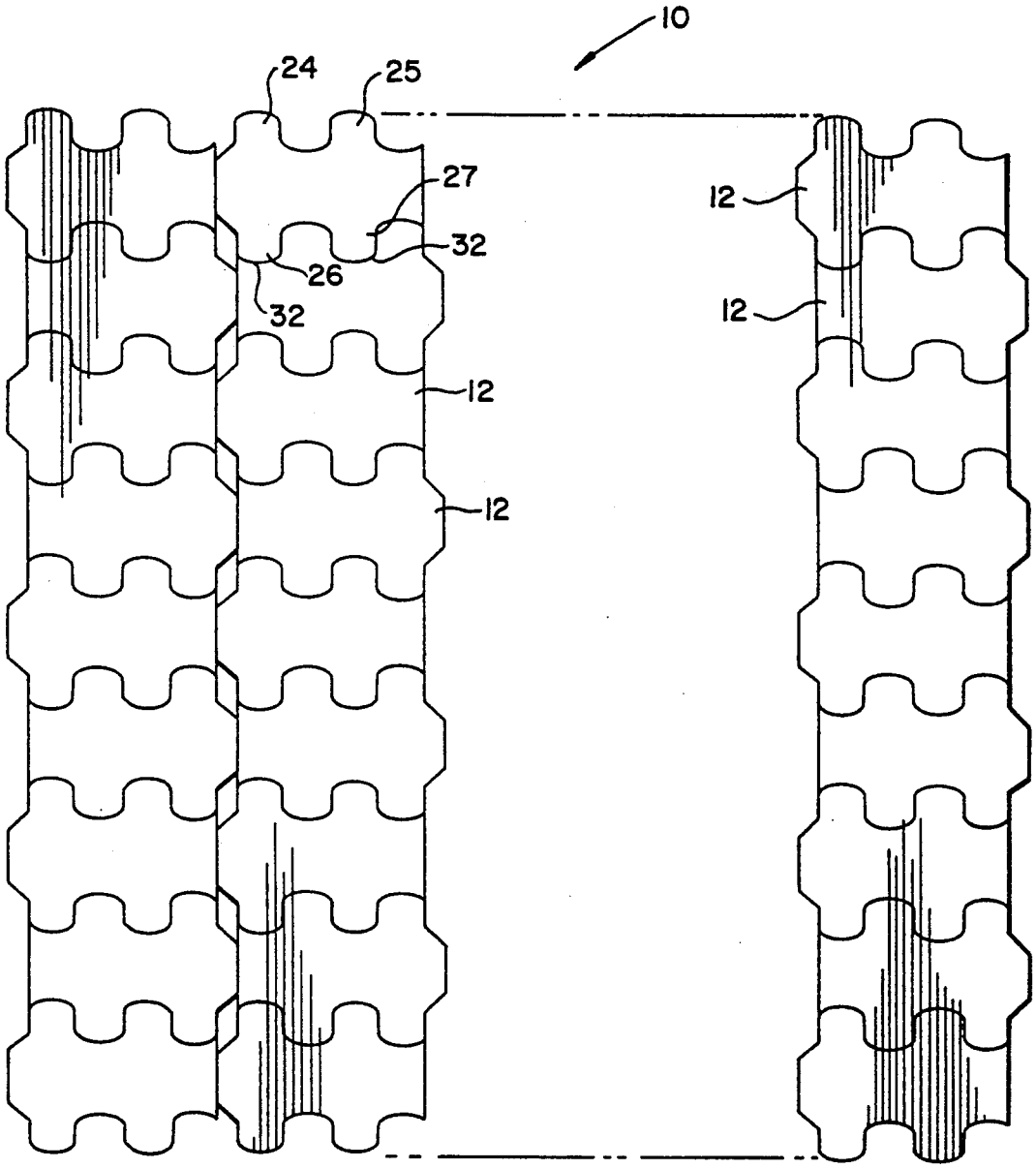
FIG. 1 is a plan view of a piece of paperboard stock material, or the like, illustrating the outlines in which carton blanks are to be cut or struck therefrom.

Referring to FIG. 1, there is shown a fragmentary, plan view of a sheet of paperboard or the like, generally indicated by the numeral 10, which is shown as being scored, cut, stamped or otherwise sub-divided into a plurality of carton blanks 12 for forming cartons in a manner to be hereinafter described.

Figure 2:
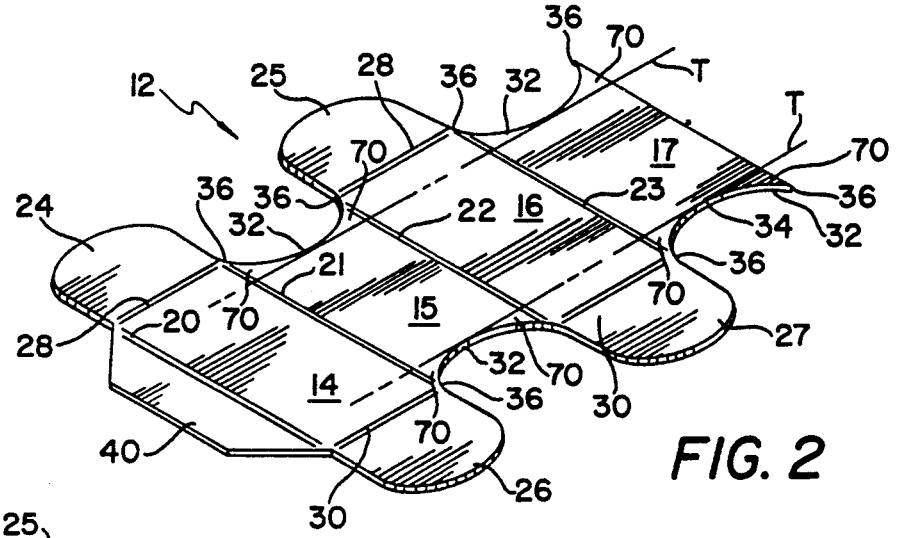
FIG. 2 is a perspective view of a carton blank formed from the stock material of FIG. 1.

A single carton blank 12, as is best shown in FIG. 2, includes a plurality of carton panels 14, 15, 16 and 17 connected together in side-by-side relation along a series of parallel fold lines 20, 21, 22 and 23. Panels 14 and 16 comprise a first pair of panels each of which is provided with a pair of closure flaps. Panel 14 has a top closure flap 24 and a bottom closure flap 26; panel 16 has a top closure flap 25 and a bottom closure flap 27. The closure flaps extend outwardly from the respective panels 14 and 16 and are attached thereto along individual top and bottom fold lines 28 and 30.

The panels 15 and 17 are not provided with closure flaps. Rather, the top and bottom margins thereof include scalloped end portions 32 defined by an inwardly extending cut edge 34 having its terminal ends 36, 36 located on and in alignment with the previously mentioned individual fold lines 28, 30. It is to be noted from FIG. 2, and also from the showing in FIG. 1, that the closure flaps 24–27, inclusive, conform to the scalloped end portions 32 of panels 15 and 17. The net result of these showings is that the end portions of the closure flaps 24, 25, 26 and 27 have been scavenged from the end panels 15 and 17 of an adjacent carton blank 12 in the paperboard sheet 10. This interfitting of the closure flaps and the scalloped end portions results in a tremendous savings of paperboard sheet material 10. In one example, it has been possible to prepare 63 carton blanks from a sheet of paperboard to be processed on a conventional 36 by 48 inch press, while previously it was only possible to prepare a total of 36 carton blanks of the same outside dimensions.

Figure 4:
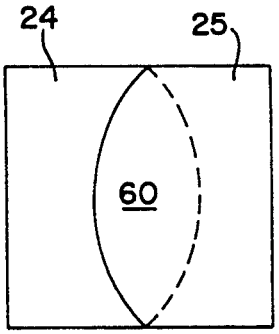
FIG. 4 is a top end view of the carton of FIG. 3.
Figure 3:
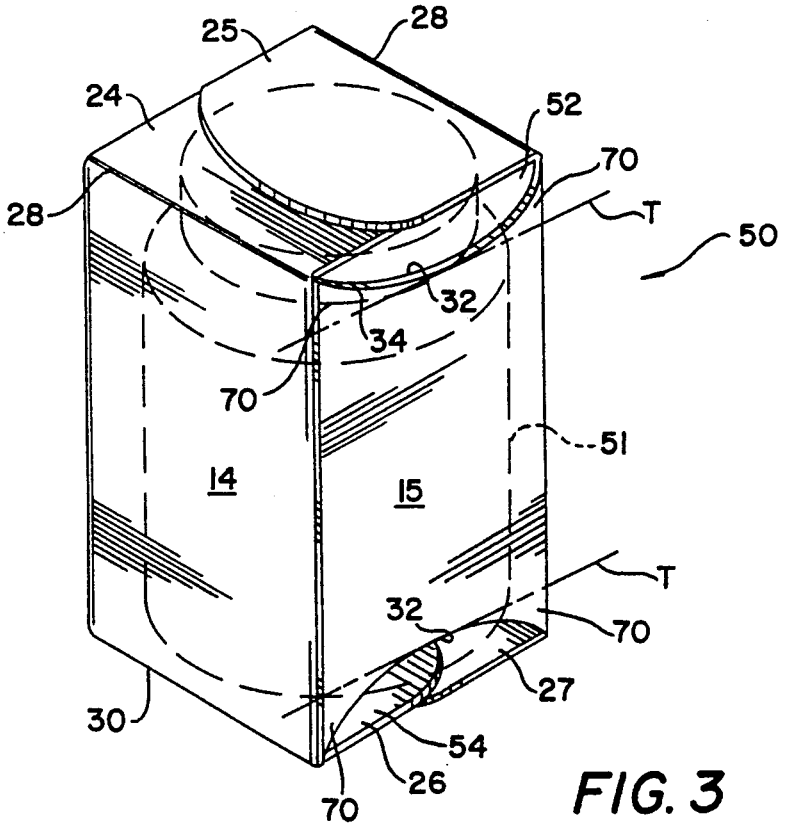
FIG. 3 is a perspective view of a carton erected from the blank of FIG. 2.

Part of the reasoning for the aforementioned savings in material will be apparent from a consideration of FIGS. 2, 3 and 4. The carton blank 12 includes glue tab 40 which is connected to panel 14 along fold line 20 and cooperates with panel 17 for forming the carton 50 which is shown in assembled form in FIG. 3. The top closure flaps 24 and 25, and the bottom closure flaps 26 and 27 are folded over and glued to each other for closing the carton 50 to contain therein a container or package 51 which is partially visible through upper windows 52 and lower windows 54. It is to be noted that the windows 52 and 54 result from the fact that material has been scavenged from panels 15 and 17, thus accounting for material savings. In addition, it should be noted in FIG. 4 that the closure flaps 24 and 25 overlap to a considerable extent across the top of the carton in order to provide a large glue area 60. Prior art cartons are known which include as many as four overlapping closure flaps, thus accounting for the use of excess material as compared to carton blank 12 and carton 50.

The present invention is particularly noteworthy, not only because of the savings in stock material, but because this savings is accomplished without unduly weakening the carton 50. As is best shown in FIGS. 2 and 3, a plurality of lines T have been placed tangential to the scalloped end portions 32 and the inwardly extending cut edges 34 in order to clearly show a series of corner portions 70 which provide reinforcement and strength to the carton 50 even in the presence of the windows 52 and 54.

A second embodiment of the invention is shown in FIGS. 5, 6, 7 and 8 wherein like numerals have been used for like parts. The main differences between the respective embodiments reside in the outline and shape of the closure flaps and resultant windows.

Panels 14 and 16, of a carton blank generally indicated by the numeral 112, are joined along a series of parallel fold lines 20, 21, 22 and 23 to a third panel 115 and a fourth panel 117. Panels 14 and 16 have outwardly extending top closure flaps 124 and 125 attached thereto along individual fold lines 28, while outwardly extending bottom closure flaps 126 and 127 are attached thereto along individual fold lines 30.

Panels 115 and 117 are provided with scalloped end portions 132 defined by inwardly extending cut edges 134 comprised of a series of straight line edges including angularly disposed lines 136 having their terminal edges at the individual fold lines 28 and 30 and ending at a straight line portion 138 which extends parallel to the fold lines 28 and 30.

Figure 5:
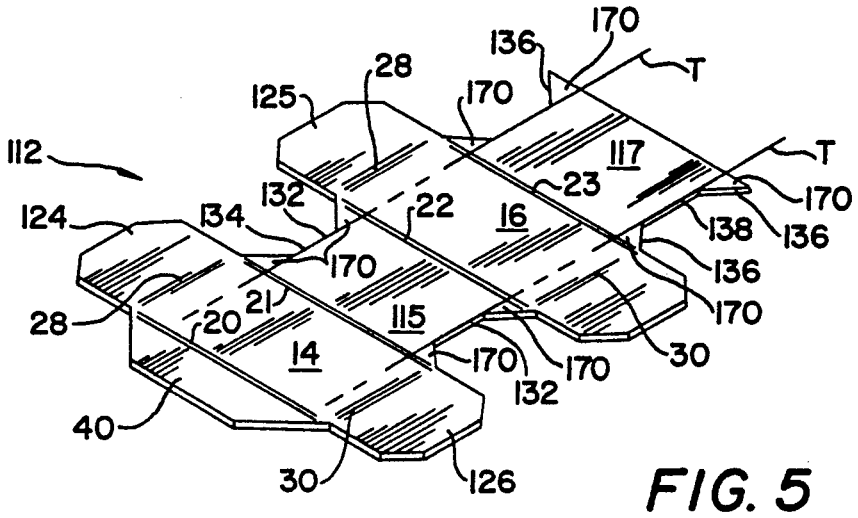
FIG. 5 is a perspective view of a modified carton blank corresponding to a second embodiment of the invention.
Figure 7:
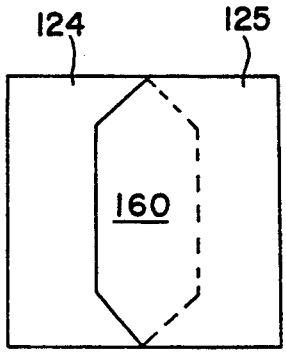
FIG. 7 is a top end view of the carton of FIG. 6.

The carton blank 112 is provided with a glue flap 40 for use in erecting the carton 150 which is shown in FIG. 5. As is seen therein, the carton 150 is provided with a top window 152 and a bottom window 154, the shapes of which correspond to the scalloped end portions 132. The overlapping top closure flaps 124 and 125, and the overlapping bottom closure flaps 126 and 127 are glued together for closing the carton 150 and retaining therein a container or package 151. As best shown in FIG. 7, the closure flaps 124 and 125 overlap to provide a large glue area 160.

Figure 8:
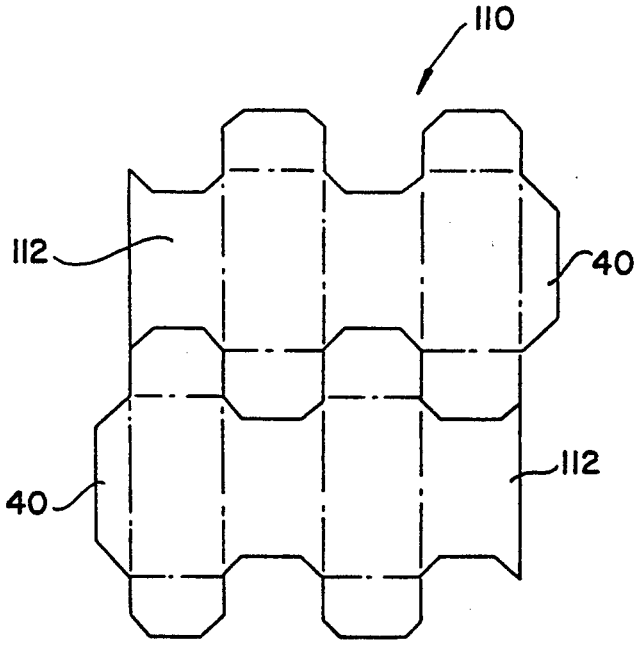
FIG. 8 is a plan view of a fragmentary portion of stock material, similar to FIG. 1, from which carton blanks are to be struck for forming carton blanks as shown in FIG. 6.

It will be readily apparent to those skilled in this art that FIG. 8 is a fragmentary showing of a sheet of paperboard stock 110 including a pair of carton blanks 112 for forming cartons 150. The same economies described above with regard to the embodiment of FIGS. 1–4, are likewise attributed to the embodiment of FIGS. 5–8.

Figure 6:
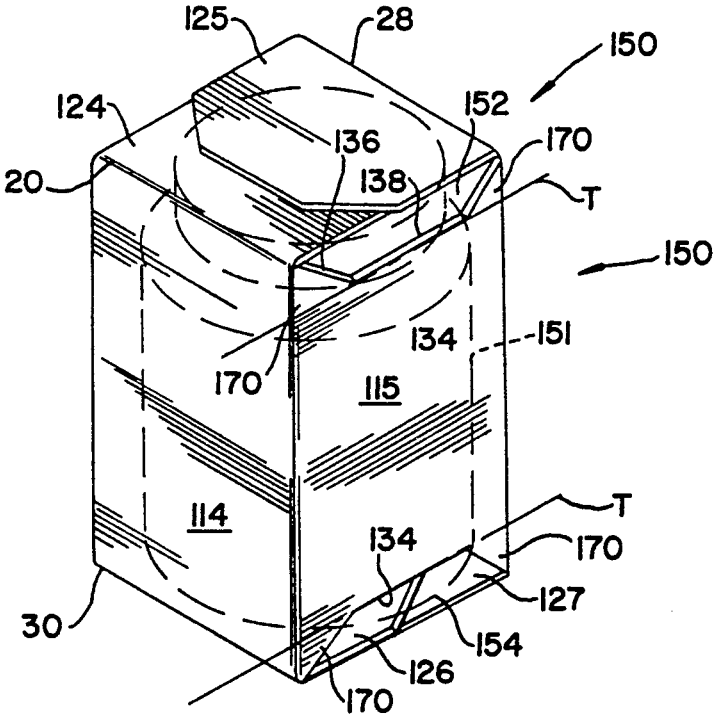
FIG. 6 is a perspective view of a carton erected from the blank of FIG. 5.

Further, as is best shown in FIGS. 5 and 6, a series of tangential lines T show that blank 112 and carton 150 are provided with corner portions 170 for reinforcing and providing strength to carton 150 in the same manner as with corner portions 70 of carton 50.

It is to be understood that descriptive terminology, such as top and bottom members, has been used for illustrative purposes and is not intended to be a limitation since it is well known that cartons of the present general type may be placed in various orientations without detracting from the invention.

Further, while the instant invention has been shown and described herein in what is believed to be the best modes and preferred embodiments, it is recognized that departures may be made therefrom within the scope of the invention as set out in the following claimed subject matter.

I claim:

1. A carton blank (12) comprising a plurality of panels (14, 15, 16, 17) connected together in side-by-side relation along a series of parallel fold lines (20, 21, 22, 23), said plurality of panels including a pair of said panels (14, 16) being spaced from each other by a third panel (15) disposed therebetween; said pair of panels each having a pair of closure flaps (24, 26) extending outwardly therefrom and being attached along individual fold lines (28, 30) disposed normal to said series of parallel fold lines; said third panel (15) and a fourth panel (17) of said plurality of panels including scalloped end portions (32, 132) for providing windows (52, 152) only in said third panel and said fourth panel in an erected carton.

2. A carton blank as defined in claim 1 wherein said scalloped end portions of said third and fourth panels conform to an outline of said closure flaps.

3. A carton blank as defined in claim 2 wherein said scalloped end portions are each defined by a single inwardly extending cut edge (34, 134) having terminal ends (36, 136) located in alignment with said individual fold lines.

4. A carton blank as defined in claim 3 wherein each said cut edge (34) is arcuate.

5. A carton blank as defined in claim 3 wherein each said cut edge (134) is defined by a pair of lines extending inwardly at a converging angle and being joined by a line extending parallel to said individual fold lines.

6. A carton blank as defined in claim 3 wherein each said cut edge defines a marginal edge of a reinforcement panel portion.

7. A carton comprised of a plurality of upstanding panels (14, 15, 16, 17) connected together in side-by-side relation along a series of vertical parallel fold lines (20, 21, 22, 23), a first pair (14, 16) of said panels being spaced from each other by a second pair (15, 17) of said panels disposed therebetween, said first pair of panels each having a pair of top and bottom closure flaps (24, 26 and 25, 27) attached along individual fold lines (28, 30), said top closure flaps and said bottom closure flaps, respectively, being disposable in overlapping relation for completely closing said carton at a top and bottom thereof; said second pair of panels including at spaced ends thereof scalloped end portions (32) formed therein for providing windows (52) in said carton solely in said second pair of panels.

8. A carton as defined in claim 7 wherein said scalloped end portions conform to the outline of said closure flaps.

9. A carton as defined in claim 8 wherein said scalloped end portions are each defined by a single inwardly extending cut edge (34) having terminal ends (36) located in alignment with said individual fold lines.

10. A carton as defined in claim 9 wherein each said cut edge is arcuate.

11. A carton as defined in claim 9 wherein each said cut edge is formed of a pair of lines extending inwardly at a converging angle and being joined by a line extending parallel to said individual fold lines.

12. A carton as defined in claim 9 wherein said scalloped end portions define corner portions in said second pair of panels for strengthening said carton.

* * * * *